United States Patent [19]

Connelly

[11] Patent Number: 4,570,924

[45] Date of Patent: Feb. 18, 1986

[54] FIREFLY ILLUSION

[76] Inventor: Keith Connelly, 344 Gertrude St.5, Syracuse, N.Y.

[21] Appl. No.: 471,234

[22] Filed: Mar. 2, 1983

[51] Int. Cl.[3] ..... A63J 21/00

[52] U.S. Cl. ..... 272/8 P; 446/485

[58] Field of Search ..... 272/8 P, 8 D, 8 N, 8 R; 46/228, 229, 226; 446/484, 485

[56] References Cited

U.S. PATENT DOCUMENTS

| | | | |
|---|---|---|---|
| 2,487,140 | 11/1949 | Karson | 272/8 R |
| 3,037,322 | 6/1962 | Baumgartner, Jr. | 46/228 |
| 3,254,444 | 6/1966 | Paterson | 46/228 |
| 3,325,940 | 6/1967 | Davis | 46/228 |

FOREIGN PATENT DOCUMENTS

| | | | |
|---|---|---|---|
| 2220982 | 10/1974 | France | 46/228 |
| 2460517 | 2/1981 | France | 46/228 |

OTHER PUBLICATIONS

Lighted Balloon Face for Halloween, from Short Cuts and Tips, p. 169.

Fairyland Magic Light-Up Wand, Bantamlite, Inc. 3-10-1966.

Atomic Lamp; Close-Up Floating Bulb; Floating Light, all from p. 253, Abbott's Magic Co., Colon, Mich. ©1976.

Zombie Flash Vanish, p. 236; Light-Fantastic, p. 275; Electric Flash Wand, p. 298, all from Louis Tannen, Inc., No. 13 Catalog of Magic ©1980, N.Y., N.Y.

*Primary Examiner*—Robert A. Hafer

*Assistant Examiner*—Arnold W. Kramer

[57] ABSTRACT

A device which effects the illusion of the levitation and animation of a source of light, supported by a non-reflective, resilient wire which under darkened conditions becomes imperceptible, carrying current to the light source from an attached circuit board/power supply which is in turn supported with the thumb by an attached flesh colored receptacle which when positioned properly, conceals the circuit board with the thumb.

1 Claim, 4 Drawing Figures

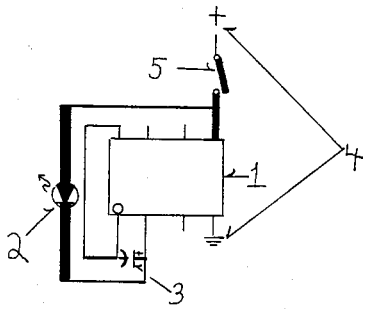
Fig.1
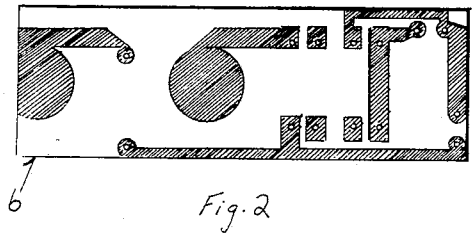
Fig.2
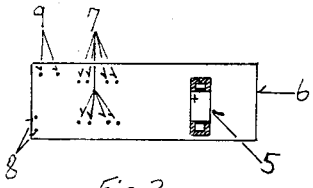
Fig.3
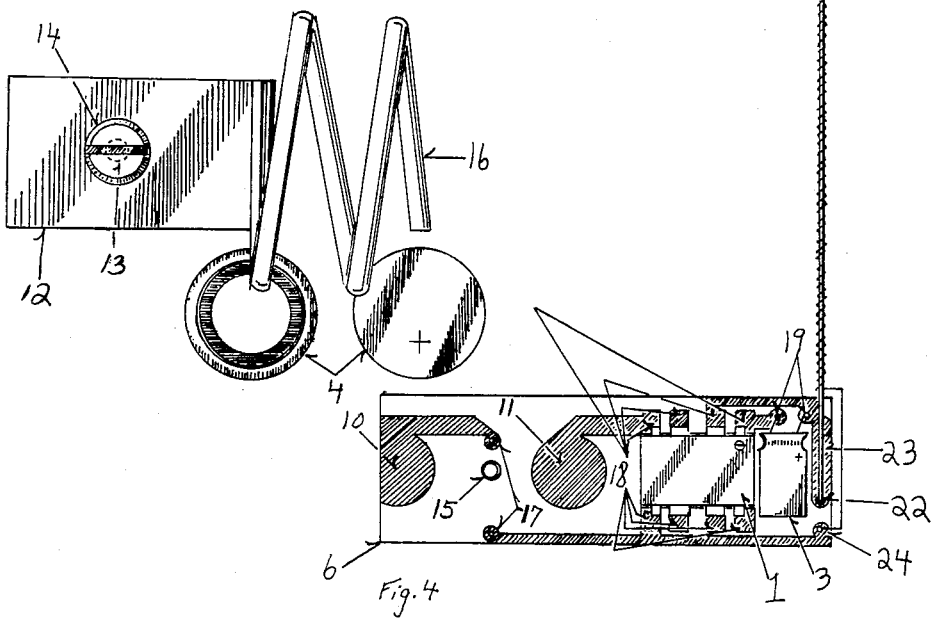
Fig.4
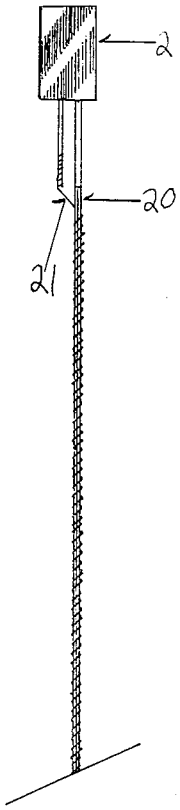

FIREFLY ILLUSION

A device, which effects the illusion of the levitation and animation of a source of light by means of supporting the light, whereas the support, under darkened lighting conditions, becomes imperceptible. The support of the device also acts as a means of supplying power to the light source by terminating the support with a miniature electronic circuit for energizing the light, which fits behind and is supported by one's thumb. The nature of the invention, is that of a magic illusion and the effect is one of a small light sources apparently magical transformaton into a state of unsupported animation.

The light source is driven by an extremely efficient means for producing high intensity flashes, implemented by an integrated circuit, designed to flash a light source.

The means of producing said flashes require very small batteries, thus lending said means to be hidden without the aid of a magicians manipulitory technique.

Support of the electronics involved is effected by a spiral loop attached to the board accomodating the electronics which fits on the thumb and allows said board to sit behind the thumb, away from the spectator's glance.

Said spiral free's the hand of any unnatural contortions to retain the device, permitting an apparent nonstructural relationship between performer and illusion.

The support of the light source, a very thin piano wire which extends from said circuit board, also serves as one of the light sources connections to said lights power source, said electronics, thus utilizing a small surface area to support said light source, enhancing the inability to perceive, from the spectators standpoint, any support of said light source.

The use of the very thin piano wire in supporting said light source, results in delayed transference of the performers movement, again disassociating the illusion from the performer.

The choice of piano wire length, once attached to said light source, is determined by locating the point at which said wire no longer solely supports said light source, without bending, when said wire is held vertically. This calibration procedure, accentuates said light sources eventual sensitivity to the performers movement.

Choosing the integrated circuits timing capacitor to achieve a flash rate just below the perception of constant, when said light source is without motion, permits an animation of said flash rate when said light source is modulated by motion.

Briefly concerning included drawings,

FIG. 1 is a schematic representation of the complete electronic circuit involved in executing the illusion.

FIG. 2 is a design of a circuit board to implement the objectives of the Firefly Illusion, shown twice actual size.

FIG. 3 shows the only component placement on the non-foil side of said circuit board, shown actual size, and FIG. 4 views all the components placement on circuit boards foil side, permanently soldered parts are shown placed while removable components are represented in exploded form, shown twice actual size.

Referring to the drawing, FIG. 1, the integrated circuit 1 is a National Semiconductor's part number LM3909, a monolithic oscillator, specifically designed to flash light emitting diodes (Stanley SPY5731 or equivalent) or a miniature light source 2 using electrolytic, 22 micro-farad, 6.3 volt, timing capacitor 3 for a voltage boost from power source 4, two Duracell RM675, 1.5 volt batteries, which energize the circuit via switch 5.

FIG. 2, the foil side of the $\frac{1}{2}'' \times 1\frac{1}{2}''$ single sided circuit board 6 supports FIG. 1's electronics, numerals 1,3, 4 and 5, together comprising the energizing circuit.

FIG. 3, the placement of a dual inline package, single pole, single throw switch 5 on the non-foil side of circuit board 6. Holes 7,8 and 9 accomodating integrated circuit 1, connections to light emitting diode or miniature light source 2 and timing capacitor 3 respectively on the opposite, foil side of circuit board 6 and are associated with the copper pads described in FIG. 4's paragraph.

In FIG. 4 copper pads 10 and 11 are lightly tinned and become respectively the positive and negative connection points for batteries 4 which are electrically connected and held in place by the $\frac{1}{2}'' \times \frac{7}{8}''$, 1/64" thick brass rectangle 12 with a $\frac{1}{8}''$ aperture 13 (view obscured by head of nylon screw 14) centered from a $\frac{7}{8}''$ edge of the rectangle 12 and 23/32" from an $\frac{1}{2}''$ edge of rectangle 12 which accomodates the $\frac{3}{8}''$ number 4/40 nylon screw 14 which secures the rectangle 12 to the number 4/40 threaded aperture 15 in circuit board 6. Attached to the $\frac{1}{2}''$ edge (the edge not used as reference for aperture 13) of rectangle 12 is a brass spiral 16 with an inner dimension of $\frac{7}{8}''$ and is painted with a flesh colored pigment. Leads from switch 5 are accommodated and soldered to points 17. Integrated circuit 1 is soldered to its respective copper pads 18. Timing capacitor 3 is soldered to its respective copper pads 19. Light emitting diode or miniature light source 2 has its cathode lead soldered to one end of piano wire or support 20 which has a length of approximately 17", shown in FIG. 4 in an abbreviated rendition because of spatial restrictions, and is 0.015" thick. The diode or miniature light source 2 has soldered to its anode lead a length of 40 gauge enameled copper wire 21 which spirals down the length of piano wire or support 20 leaving about an $\frac{1}{2}''$ of piano wire or support 20 bare to be later soldered to circuit board 6. The enameled wire 21 may be secured at several points along the piano wire or support 20 with some varnish. The end of piano wire or support 20 soldered to circuit board 6 will be bent at a 90 degree angle, $\frac{1}{8}''$ from its end that is inserted into its designated connection point 22 and soldered at several points along copper strip 23 of circuit board 6. Enameled wire 21 is soldered to its designated connection point 24. The circuit board 6 and light emitting diode or miniature light source 2 are masked and piano wire or support 20 and enameled wire 21 are painted flat black.

With the unit of FIG. 4 (or the device which effects the illusion of the levitation and animation of a miniature light source) assembled and switch 5 in the on position, insert thumb in spiral 16 so that the foil side of cicuit board 6 faces the back of the right thumb, the non-foil side faces the center of the torso and piano wire or support 20 drapes over said thumb, supporting light emitting diode or miniature light source 2 in a freely moving manner. The piano wire or support 20 is closest to the tip of the thumb and if supported the piano wire's greater length would be in the upwards direction. The illusion is performed against a darkened background including clothing and under less than average lighting conditions. Piano wire or support 20 responds to the slightest hint of motion, a point to consider in a subtle execution of the illusion. Synchronizing the light emitting diode's deflection to the beat of appropriate music enhances the performer's apparent will over the Firefly. Displacement of the performance wrist with variations on the motion imparted to the light emitting diode or miniature light source 2 effects the appearence of random path's ostensibly choosen by the Firefly.

I claim:

1. A device which effects the illusion of the levitation and animation of a miniature light source comprising flesh colored means for receiving the end of a finger, miniature circuit board means fixed to said flesh colored means, said circuit board means being hidden from the view of an audience when the user's finger tip or thumb is inserted into said flesh colored means and the attitude of the finger or thumb is properly positioned, a miniature light source, an elongated stiff but resilient wire means of a flat black color connected to one end to said circuit board means and at the other to said miniature light source for carrying current from said circuit board means to said miniature light source and supporting said light source in flexible levitation, and control and power means in said circuit board means for activating and energizing said miniature light source through said wire means, wherein under darkened lighting conditions the miniature light source can be made to float or undulate with no apparent perceptible means of support or activation.

* * * * *